United States Patent [19]

Hunn

[11] Patent Number: 4,637,606

[45] Date of Patent: Jan. 20, 1987

[54] JUMP ROPE

[76] Inventor: Kevin W. Hunn, 2890 S. Wentworth Ave., Milwaukee, Wis. 53207

[21] Appl. No.: 642,034

[22] Filed: Aug. 17, 1984

[51] Int. Cl.[4] ..... A63B 5/20

[52] U.S. Cl. ..... 272/75

[58] Field of Search ..... 272/74, 75; 273/26 E, 273/26 EA, 29 A, 184 B, 185 C, 185 D, 196, 197 R, 197 A

[56] References Cited

U.S. PATENT DOCUMENTS

| | | | |
|---|---|---|---|
| 1,584,122 | 5/1926 | Moore | 272/75 |
| 1,765,518 | 6/1930 | Williams | 273/184 B |
| 3,124,958 | 3/1964 | McDonnel | 273/184 B |
| 4,101,123 | 7/1978 | Anthony | 272/75 |
| 4,407,503 | 10/1983 | Nishizawa | 273/197 R |

FOREIGN PATENT DOCUMENTS

| | | | |
|---|---|---|---|
| 1164490 | 3/1984 | Canada | 272/74 |
| 0605358 | 5/1926 | France | 272/75 |

*Primary Examiner*—Robert A. Hafer
*Assistant Examiner*—Kathleen J. D'Arrigo
*Attorney, Agent, or Firm*—Andrus, Sceales, Starke & Sawall

[57] ABSTRACT

A jump rope unit includes compact radial bearing into connecting each handle to the rope. A universal connector between the bearing and rope establishes essentially unrestricted rope motion. The bearing includes a low friction plastic member rigidly affixed to the handle and having an annular exterior recess. A low friction plastic ring is located within the recess and is free to rotate therein. The rope is secured to the ring periphery by the universal connector. The ring has slight axial movement as well as radial movement. The universal connector includes a ring secured to the bearing, a snap clamp secured to the ring having a saddle member secured to an end pin. An eye hook is connected to the saddle member by a ring. Alternatively, the ring may have an encircling opening through which the rope end passes and is secured upon itself.

3 Claims, 6 Drawing Figures

JUMP ROPE

BACKGROUND OF THE PRESENT INVENTION

This invention relates to a jump rope and particularly to a jump rope having relatively rigid handles secured to the opposite ends of the rope.

Jump ropes have for many years been used both as toys by children and as exercise devices by persons interested in physical fitness, particularly with the relatively substantial increased interest in physical fitness. Competitive jumping is now also common. Jump rope construction has become more complex and sophisticated, particularly with an increasing demand by competitive jumpers for greater rapidity of rope rotation, flexibility of movement and ease of movement. Frictional forces involved in the connection of the flexible rope to the handle structures held by the jumper are a particular area of interest which has received significant attention. The frictional forces created at the connection of the rope to the handle restricts the rotational speed and of course creates a load on the person's arm. The handle connection also constitutes a principle source of wear on the rope, requiring frequent replacement. Professional type jump ropes are generally relatively costly.

Adults involved in personal fitness often subject jump ropes to strenuous jumping conditions. In addition, experts and professional jumpers who jump competitively of course require the highest quality jump rope. As a result, rather sophisticated systems have been developed for connecting of a rope to a rigid handle.

U.S. Pat. No. 4,179,119 which issued Dec. 18, 1979 discloses a skipping rope having a tubular wooden handle with the interior forming an elongated axial journal or sleeve bearing. A rotatable rod is journaled in the tubular handle and extends outwardly thereof to form a peg protruding from the handle. The peg has a plurality of transverse openings for coupling of the rope to the peg. The patent describes other prior art rigid connection to the handle and the creation of a high stress point resulting in a premature destruction of the rope which is avoided by the structure disclosed in the patent. In use, as the rope rotates, the rod rotates within the elongated sleeve bearing. Other special structures have also been suggested. A spring-loaded ball bearing unit is disclosed in U.S. Pat. No. 4,330,118 which issued May 18, 1982. In the latter patent, the handle is formed with a tubular cup shaped conical fastener which protrudes from the rope end of the handle. A plurality of ball elements are uniformly spaced within the conical fastener and held in place by a spring-loaded retainer. Still other patents have shown special structures and connections of jumping rope for other purposes or reasons. For example, U.S. Pat. No. 438,489 which issued in 1890 discloses a musical skipping rope having a conventional clapper arrangement in which the handle is connected by an offset ratcheting noise making mechanism. The ratchet wheel is secured to the handle and with the ratchet arm extending at right angles therefrom and with the jump rope being interconnected to the ratchet arm by a transverse coupling. Hoop-type jumping toys are shown for example in U.S. Pat. No. 2,039,731 and 4,049,264. Jump ropes with various other forms of interconnection are additionally shown in U.S. Pat. Nos. 4,093,211, 1,371,915, 2,253,075, 4,136,866, 4,157,827, 4,177,985, 4,201,382, 4,375,886, 4,385,759, 4,293,125, 3,554,539, 3,958,802, 4,135,713, and 4,192,501.

There is a continuing demand for increasing the rotational speed of the jump rope without creating undue loads on the connection of the rope and handle and without increasing the load on the jumper. The prior art devices which are all directed to certain aspects of the jump rope connection still include interconnections which involve an undesirable amount of frictional forces, particularly when a change in the jumping motion is created; for example, changes from the conventional simple straightforward loop movement about the body to a criss-crossing of the rope during the formation of the loop and the like.

Notwithstanding the extensive development over the years in the handle structures for jump ropes, there remains a substantial demand and need for a more reliable and long-life handle structure.

SUMMARY OF THE PRESENT INVENTION

The present invention is particularly directed to an improved jump rope handle structure for a jump rope unit which has been found to include a long-life handle connection to a flexible jump rope while introducing minimal frictional forces which must be overcome in rotating the rope. Generally, in accordance with the teaching of the present invention, the handle unit includes a compact radial bearing assembly with the rope connected to the outer bearing race means. More particularly, the radial bearing assembly includes a compact radial bearing having an inner race secured to the outer rope-end of the handle and an outer annular race journaled on the inner race. The rope is secured to the outer race. The rope connection in an optimuim and unique construction, includes a universal joint connector which establishes essentially unrestricted motion of the rope at that point.

Although the bearing assembly may be any suitable construction, the inventor has found a particularly simplified and unique structure includes a low friction plastic member rigidly affixed to the handle and having an annular exterior recess. A low friction plastic ring is located within the recess, and is free to rotate on the handle. The rope is secured to the periphery of the ring and preferably with the universal connector. In one preferred novel embodiment, the rotating recess and ring are constructed and arranged to allow slight axial movement as well as radial movement such that relative movement of the end of the rope with respect to the handle structure is permitted. Although this structure is found to require a slight additional motion to initiate the rotation of the jump rope, the construction contributes to minimizing rotational forces and permitting complex rope movement, such as crossing of the ends of the rope to define a FIG. 8 jumping pattern or the like.

The handle-attached bearing member is preferably formed of an ultra-high molecular weight material such as that manufactured and sold under the trademark Delrin. The ring member should be formed of an extremely hard material and again can be a suitable selected ultra-high molecular weight material such as "Nylon". Such plastic materials are readily available and have extremely low friction characteristics while permitting appropriate forming by molding or the like to permit manufacture with conventional and commercially available equipment.

A simplified and inexpensive rope connection may be used in which the rope is passed through a U-shaped passageways in the outer bearing ring member and clamped in place as to itself. The rope clamp may be made releasable to permit adjustment of the rope length or alternatively of course the unit could be sold with a separate rope and clamp to allow the user to select a given rope length which is fixedly secured in place to define a fixed-length jump rope.

Although the universal coupling can take anyone of a great variety of forms, a satisfactory form includes a ring member secured to the periphery of the outer ring bearing. A snap clamp is secured to the ring member and has a saddle member secured to an end pin. The rope is provided with a hook or eye end which is connected to the saddle member by a connecting ring. Such a coupling has been used and found to provide a highly satisfactory jumping rope coupling which is readily commercially produced.

The structure of the present invention has been found to introduce much less friction than any other rope connection known to the inventor. Further, the structure is relatively simple and the friction forces exist between the special bearing surfaces which particularly minimize bending and twisting forces on the rope. The coupling may be formed as a relatively small and lightweight coupling. The components must of course have sufficient physical strength to withstand the forces involved during the actual high speed rotation of the rope.

The present invention, particularly with the interposed universal coupling, avoids the twisting forces on the handle-rope connection and allows high speed motion of the rope with minimal friction forces. The rope is also maintained rotating at high speeds with a significant reduction in the circular motion of the jumper's hand from that of the prior art handles. Thus, the movement of the rope does not require significant arm movement and the rope can be rotated using torso and slight wrist motion. This produces a more natural aerobic exercise, as well as development of a natural jumping cadence or rhythm. Further, the ease of rotating the rope allows the beginner and novice to learn more rapidly and to more rapidly. The beginner does not need to concentrate heavily on the rotating of the rope and can more quickly develop a relaxed rhythm and comfortable jumping style, thereby avoiding the discouragement often encountered by beginners.

The present invention thus provides an improved, reliable and relatively inexpensive jump rope attachment structure.

BRIEF DESCRIPTION OF THE DRAWING

The drawing illustrates the best mode presently contemplated for carrying out the invention.

In the drawing.

DESCRIPTION OF THE ILLUSTRATED EMBODIMENTS

Figure 1:
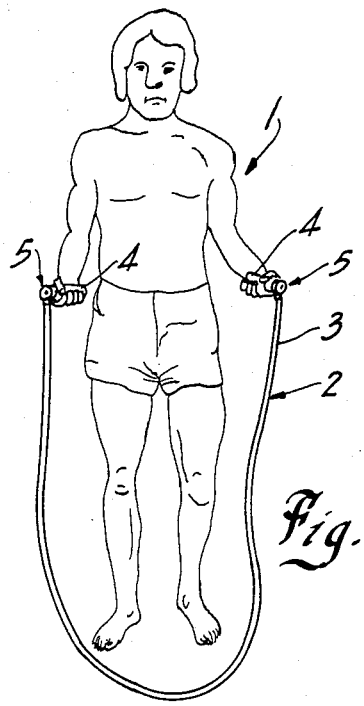
FIG. 1 is a simplified illustration of a jumper using a rope unit incorporating a handle structure constructed in accordance with the present invention.

Referring to the drawing and particularly to FIG. 1, a rope jumper 1 is illustrated jumping with a jump rope unit 2 including an elongated flexible rope 3 having similar rigid handles 4 at the opposite ends. The rope 3 may be of any suitable variety or construction such as a simple stranded woven cotton, plastic or braided metal. The opposite ends of the rope 3 are similarly secured to the handles 4 by a special bearing connector 5 which particularly illustrates a preferred form of the subject matter of the present invention. In the illustrated embodiment of the invention, each handle connector 5 is shown having an integrated rotary bearing unit 6 which has the end of rope 3 secured to the periphery of the unit 6 by a universal coupling unit 7. The connector 5 is constructed such that the rope 3 not only projects radially from the rigid handle 4 but with the rope forces within the radial bearing connector 5 located to minimize the load on the hand of the jumper during rotational movement of the rope 3.

The illustrated handles 4 are solid cylindrical members adapted to be firmly grasped by the hand of the jumper 2. The radial bearing connector 5 is secured to the outer end of the handle 4 immediately adjacent to the hand gripping portion. The handle may be formed of plastic, wood, metal or any other desired material. Although shown as a smooth cylindrical handle, a conventional undulated finger-gripping surface or portion may be provided on the outer surface. Further although shown as solid, a simple tubular member may be used. The only restrictions on the handle is that it shall have sufficient strength to allow firm gripping by the jumper, and support for bearing connector 5. No further description of the rope 2 or the handle 4 is therefore given other than as necessary to clearly describe the illustrated embodiment of the invention.

Figure 2:
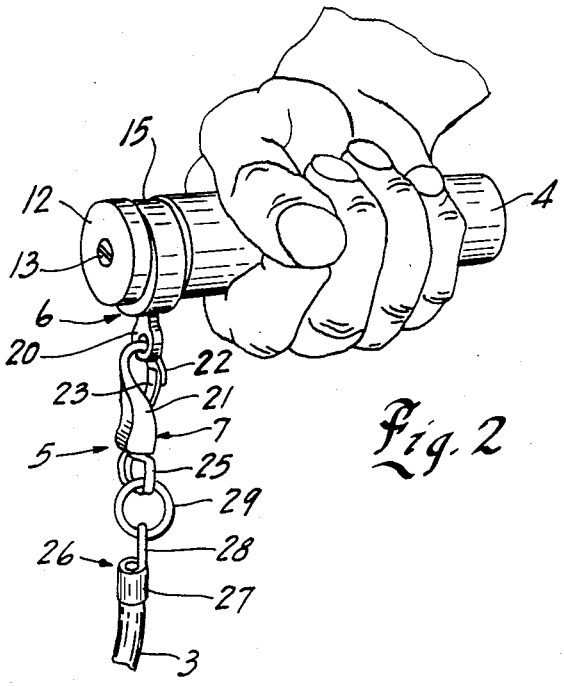
FIG. 2 is an enlarged view illustrating the hand hold position of the handle of the rope unit.
Figure 4:
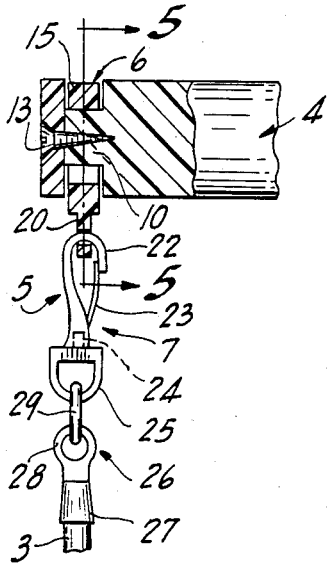
FIG. 4 is a fragmentary cross-sectional view through the handle more clearly illustrating the bearing structure and the connection of the rope to the handle.
Figure 3:
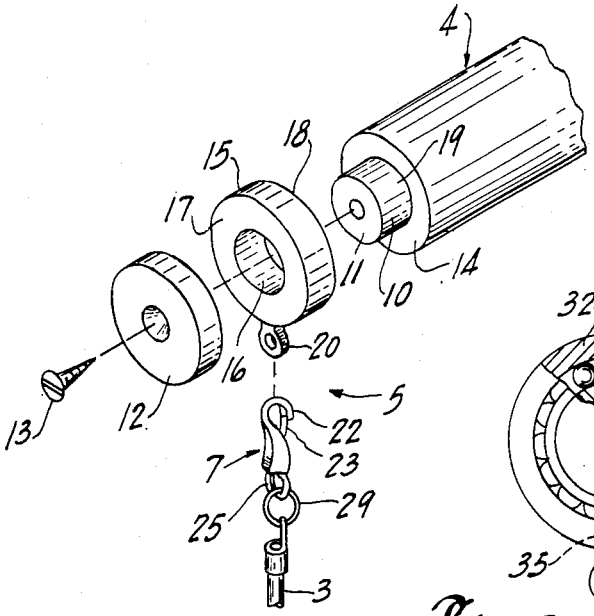
FIG. 3 is an exploded view of the handle.

More particularly, and as more clearly shown in FIGS. 2–4, the bearing unit 6 includes an inner bearing shaft 10 formed as an integrated axial extension of the handle 4. The shaft 10 is preferably formed with a smooth outer surface and of a selected diameter to provide sufficient strength to withstand the forces created by the rotating rope 3. The shaft 10 protrudes outwardly from the end of the hand-gripping portion of the handle 4 and has a smooth flat end surface 11 which is perpendicular to the axis of the handle. A removable outer or end wall 12 is secured to the end of the shaft 10 in any suitable manner as by a coupling screw 13 which passes through the end the wall and threads into a threaded opening in the shaft 10. The end wall 12 is thus firmly affixed to the end of the shaft. The end wall 12 is shown as disc-like members and is also formed with a flat or planar inner end surface. The end 14 of handle 4, shaft 10 and flat end wall 12 form an annular recess defining a journal and end thrust bearings and hereinafter referred to as an inner bearing race of a relatively low friction surfaces. The plastic selected for the inner members of the bearing race members is any suitable low friction material. One example of a material which had been satisfactorily used is the commercially available plastic sold by DuPont Company under the trade mark "Delrin". A ring bearing 15 is located on the shaft 10 within the inner bearing race and thus journaled on shaft 10 in such inner race. The illustrated ring bearing 15 is a solid plastic ring-shaped member having an inner opening 16 of a diameter slightly greater than that of the shaft 12. The bearing 15 has a rectangular cross-section with flat parallel end walls 17 and 18. The axial thickness of the ring bearing 15 is preferably slightly less than the axial length of the inner bearing race, as most clearly shown in FIG. 4. The exterior diameter of the ring bearing 15 is slightly greater than the outer diameter of the inner bearing race. The ring bearing 15 is directly subjected to the relatively high forces and stresses created by the rotation of the jumping rope 3 and the ring bearing 15 is preferably formed of a harder material than the components of the inner bearing race. For example, a suitable plastic material which has been used is commercially available and sold by the DuPont Company under the trademark "Nylon". The ring bearing 15 is preferably formed of a different plastic from that of the components 10, 11 and 12 forming the inner bearing race. The different plastics may be selected to further minimize frictional forces.

A small relief recess 19 is shown at the junction of the shaft 10 and handle 4 to eliminate a friction location.

The ring bearing 15 not only freely rotates on the handle shaft 10 but is free to move axially and radially within the bearing race. The movement of the bearing ring bearing within the bearing recess race has been found to provide an improved free movement of the jumping rope 3 as more fully developed hereinafter.

In the embodiment of the invention shown in FIGS. 1–4, a rope coupling eyelet 20 is provided on the exterior periphery of the bearing ring 15 for interconnection of the rope 3 by the coupling 7. The eyelet 20 extends radially outwardly from the ring bearing 15 to form a part of the universal coupling 7. A snap swivel unit 21 includes a snap hook connector 22 releasably attached to the eyelet 20. The snap swivel unit 21 is a well-known device having the hook member connector adapted to snap over the eyelet 20 and with a release spring 23 secured to the base of the hook and extending to the free end of the hook to close the opening thereto. The base end of the hook connector 22 is formed with a projecting pin 24 on which a D-shaped swivel member 25 is rotatably secured. The end of the rope 3 is provided with a connector 26 having a shank 27 crimped onto the metal rope 3 and an in-line end eyelet 28. A split or key-type ring 29 interconnects swivel member 25 to the end eyelet 28 to complete a universal swivel coupling 7 between the rope 4 and the radial bearing unit 6. The universal movement of the coupled end of the rope 3 to the bearing unit 6 during the rotational rope movements and the interrelated conjoint forces created as the rope rotates and engages with the ground or the like results in optinum low friction support of the rotating rope 4.

The illustrated radial bearing unit 6 provides a simple and readily constructed assembly using well-known and readily available materials. In addition, the several components of the bearing assembly may be formed of simple, straightforward construction techniques which are widely used in the formation of plastic products. The inner bearing end and shaft, the end wall and bearing ring may for example be formed from a suitable bar or tube stock of the selected plastic for suitably machining. Alternately the several elements may be molded from appropriate plastic.

The rope connection with respect to the handle 4 in particular results in rope movement without bending and undue stressing of the rope 3 at the connection, thereby contributing to a long useful life of the rope.

The universal coupling 7 with the end ring connections is significant to establish an essentially universal movement of the rope end relative to the outer bearing race. This action is particularly significant and important when doing sophisticated rope jumping such as cross over jumping where the hands are criss-crossed in front of the jumper to provide a corresponding movement of the end portions of rope while maintaining the jumping loop moving about the jumper. As the handles are criss-crossed, the rope moves into a smaller loop and the movement tends to distort the cable connection at the handle. Generally, the jumper encounters a significant increase in the frictional forces. With the present invention, minimal if any additional forces are created during such crossover movement of the rope.

Generally, the inventor has also found that the compact radial rotary bearing with the ring type connection minimizes the frictional forces. The rope is easy to rotate at the high speeds necessary for experienced, and particularly competitive, jumpers. The minimization of the forces is particularly significant to professional and competitive jumpers who may jump for long periods of time and any unnecessary forces required to rotate the rope of course adversely affects the ability of the jumper. The rope reaches its normal speed with little force required to maintain the rope rotating at the desired speed.

The jump rope handle connection apparatus of the present invention provides a relatively simple reliable and improved rope connection permitting requiring less force and energy to maintain the rope movement.

Figure 5:
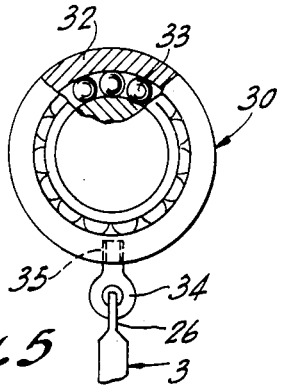
FIG. 5 is a sectional view of an alternate bearing unit adapted to be used in the handle structure shown in FIGS. 1–5.

Although the radial bearing unit having the improved plastic bearing surfaces illustrated in FIGS. 1–4 provides an inexpensive and highly satisfactory unit, various modifications can obviously be provided within the teaching of the present invention. For example in FIG. 5, the ring bearing unit illustrated in FIGS. 1–4 has been replaced with a conventional ball bearing unit 30. In this embodiment, the inner race 31 of the ball bearing unit 30 is suitably affixed to the handle 4. The outer race 32 is of course free to rotate, with the suitable bearing balls 33 interposed between the races. In the second embodiment, a rope coupling eyelet 34 is secured to the outer race 32 as by a threaded shaft 35 which threads into a tapped opening in the outer race.

Figure 6:
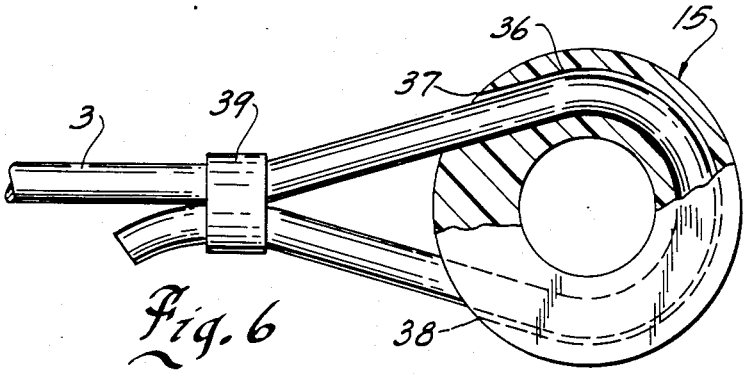
FIG. 6 is a view of a further coupling adapted to be used in connection with a handle structure such as shown in FIGS. 1–4 and constructed in accordance with the present invention.

A less expensive rope attachment unit may include having an outer rotating ring bearing connected directly to the rope such as shown in FIG. 6.

The embodiment of FIG. 6 may otherwise be similar to that of the first embodiment and corresponding elements are therefore similarly numbered.

In the embodiment of FIG. 6, the ring bearing 15 is formed with an annular internal passageway 36 exiting at spaced peripheral openings 37 and 38. The passageway 36 has a diameter slightly greater than the diameter of the jump rope 3. In assembly, the jump rope 3 is threaded through one opening 37 into and through the passageway 36, with the free end extending outwardly through the opposite opening 38 adjacent the rope 3. The free end is secured upon the rope 3 adjacent the openings 37–38 in any suitable manner such as by an encircling connector, shown as a crimped clamp member 39. The openings 37 and 38 are circumferentially spaced to one side of the ring member and extend tangentially to the passageway. The rope 3 thus extends from the passageway 36, within the bearing, to the connector 39. This provides a simple reliable and inexpensive means of interconnecting the rope 3 and permitting adjustment of the rope 3 by the original purchaser of the unit. For example, the rope 3 is shipped separate from the handle 4 and bearing assembly 6. The crimped connector 39 is readily applied using a simple conventional pliers or the like. The length is a significant factor in providing ease of movement and better jumping performance. The other embodiments may also use a crimped or other form of connection which may be applied by the purchaser or user. If desired, the clamp member may of course be a suitable releasable clamp unit, not shown, permitting subsequent adjustment of the rope length.

Generally, the present invention requires the use of the compact radial rotary bearing assembly secured to the end of the handle, and except where cost is a most significant consideration, some form of a universal-type coupling provided between the outer bearing race and the rope. Various other modifications to the structure can be provided within the teaching of the present invention.

Various modes of carrying out the invention are contemplated as being within the scope of the following claims particularly pointing out and distinctly claiming the subject matter which is regarded as the invention.

I claim:

1. A jump rope unit, comprising a rigid handle adapted to be attached to the end of a flexible rope, said handle having a hand gripping portion, a rope connecting bearing unit secured to the rope end of said handle, said bearing unit including an axially extending plastic shaft integral with said hand gripping portion and projecting from an annular planar plastic end face on said hand gripping portion, an outer end wall secured to said shaft in outwardly spaced relation to said end face, said outer end wall having an inner plastic bearing face parallel to said annular planar plastic end face and with said shaft defining an annular race having a U-shaped cross-section, a bearing ring journaled on said shaft and having an outside diameter substantially equal to the diameter of said end face and having an inner opening slightly larger than said shaft and an axial length slightly less than the spacing of said outer end wall from said end face, said bearing ring having plastic surfaces engaging said shaft and said outer end wall and said end face to establish low friction bearing surfaces, and a rope-securing means secured to said ring for securement to a rope.

2. The jump rope of claim 1 wherein said rope-securing means includes an eyelet member secured to the periphery of said bearing ring, and a round connector coupled to said eyelet member and adapted to be secured to the end of the rope to permit essentially unrestricted movement of said rope.

3. The jump rope unit of claim 1 wherein said rope-securing includes a circumferentially extended opening within said ring, said opening being less than the total circumference of the ring and having entrance and exit openings spaced adjacent each other to permit passing of an end of a rope through said extended opening for affixing the rope to the ring.

* * * * *